US009650689B2

(12) United States Patent
Fujiwara et al.

(10) Patent No.: US 9,650,689 B2
(45) **Date of Patent: *May 16, 2017**

(54) METHOD FOR OPERATING A BLAST FURNACE

(75) Inventors: Daiki Fujiwara, Fukuyama (JP); Akinori Murao, Fukuyama (JP); Shiro Watakabe, Fukuyama (JP)

(73) Assignee: JFE Steel Corporation (JP)

( * ) Notice: Subject to any disclaimer, the term of this patent is extended or adjusted under 35 U.S.C. 154(b) by 324 days.

This patent is subject to a terminal disclaimer.

(21) Appl. No.: 14/233,027

(22) PCT Filed: Jul. 11, 2012

(86) PCT No.: PCT/JP2012/004464

§ 371 (c)(1),
(2), (4) Date: Jan. 21, 2014

(87) PCT Pub. No.: WO2013/011662

PCT Pub. Date: Jan. 24, 2013

(65) Prior Publication Data

US 2014/0159287 A1 Jun. 12, 2014

(30) Foreign Application Priority Data

Jul. 15, 2011 (JP) ..... 2011-156957
Jul. 15, 2011 (JP) ..... 2011-156958

(51) Int. Cl.
*C21B 7/16* (2006.01)
*C21B 5/00* (2006.01)

(52) U.S. Cl.
CPC ..... *C21B 7/16* (2013.01); *C21B 5/003* (2013.01); *C21B 7/163* (2013.01)

(58) Field of Classification Search
CPC C21B 5/003; C21B 7/16; C21B 7/163; C21B 5/001; C21B 5/004
See application file for complete search history.

(56) References Cited

U.S. PATENT DOCUMENTS

| | | | |
|---|---|---|---|
| 5,227,117 | A | 7/1993 | Derucki et al. |
| 5,522,916 | A | 6/1996 | Karinthi et al. |
| 2009/0325110 | A1 | 12/2009 | Mahoney et al. |

FOREIGN PATENT DOCUMENTS

| | | |
|---|---|---|
| EP | 0 922 772 | 6/1999 |
| JP | 64-28312 | 1/1989 |

(Continued)

OTHER PUBLICATIONS

Supplementary European Search Report dated Sep. 17, 2015 of corresponding European Application No. 12815299.8.

(Continued)

*Primary Examiner* — Lois Zheng
(74) *Attorney, Agent, or Firm* — DLA Piper LLP (US)

(57) ABSTRACT

A method of operating a blast furnace includes two or more lances that inject reducing agents from a tuyere; injecting a solid reducing agent and a flammable reducing agent from different lances; and disposing the lances so that an axial line that extends from an end of the lance that injects the solid reducing agent and is the axial line of the lance that injects the solid reducing agent and an axial line that extends from an end of the lance that injects the flammable reducing agent and is the axial line of the lance that injects the flammable reducing agent cross each other, and so that a main flow of the solid reducing agent injected and a main flow of the flammable reducing agent injected overlap.

18 Claims, 10 Drawing Sheets

(56) References Cited

FOREIGN PATENT DOCUMENTS

| | | | | |
|---|---|---|---|---|
| JP | 04-268003 | | 9/1992 | |
| JP | 11-241109 | * | 9/1999 | ..... C21B 5/00 |
| JP | 11-302710 | | 11/1999 | |
| JP | 11-315310 | | 11/1999 | |
| JP | 2000-178614 | * | 6/2000 | ..... C21B 5/00 |
| JP | 2006-241586 | | 9/2006 | |
| JP | 2006-291251 | | 10/2006 | |
| JP | 2007-162038 | | 6/2007 | |
| JP | 2009-235482 | | 10/2009 | |
| KR | 10-2009-0130471 | | 12/2009 | |
| KR | 2011-0048972 | * | 5/2011 | ..... C21B 5/00 |
| WO | 94/20642 | | 9/1994 | |

OTHER PUBLICATIONS

Korean Office Action dated Feb. 17, 2016 of corresponding Korean Application No. 2014-7000750 along with a Concise Statement of Relevance of Office Action in English.

* cited by examiner

FIG. 6

| ITEM | LANCE STRUCTURE | | TRAVEL/DIFFUSION STATE BLOWING-IN DIRECTION | EVALUATION | | | | |
|---|---|---|---|---|---|---|---|---|
| | AXIAL CROSS SECTION | | | TEMPERATURE | COMBUSTION POSITION | CHAR | DIFFUSIBILITY | OVERALL |
| SINGLE-WALL LANCE (ONLY PC) | ID:Φ16.7 | PC+N2 | INJECT INJECT | — | — | — | — | — |
| DOUBLE-WALL LANCE (1) (INSIDE PC, OUTSIDE LNG) | ID:Φ25.0 ID:Φ16.7 | LNG PC+N2 LNG | INJECT INJECT (1) AMBIENT TEMPERATURE RISE ⇒ HEATING SPEED INCREASE | △ | ○ | △ | △ | △ |
| DOUBLE-WALL LANCE (2) (INSIDE LNG, OUTSIDE PC) | ID:Φ25.0 ID:Φ12.7 | PC+N2 LNG PC+N2 | INJECT INJECT (2) INNER-SIDE LNG COMBUSTION DIFFUSIBILITY ENHANCED ⇒ | ○ | △ | ○ | ◎ | ○ |

FIG. 7
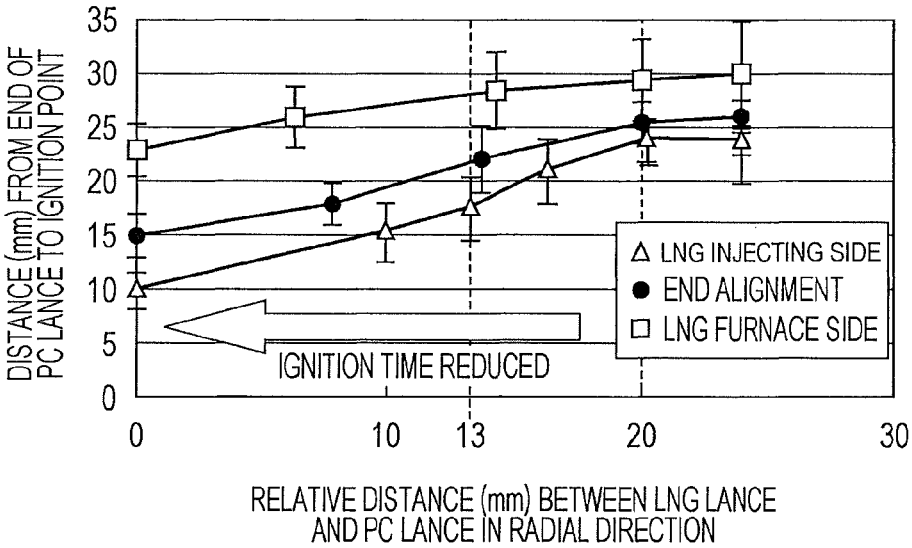
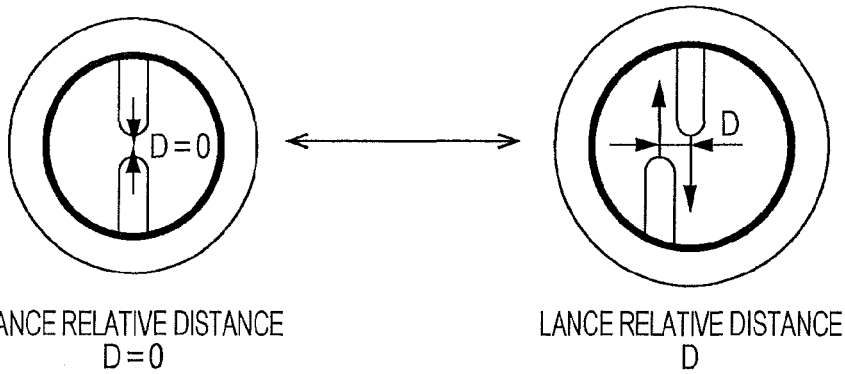

METHOD FOR OPERATING A BLAST FURNACE

TECHNICAL FIELD

This disclosure relates to a method of operating a blast furnace that makes it possible to increase productivity and reduce unit consumption of a reducing agent by increasing combustion temperature as a result of injecting a solid reducing agent such as pulverized coal, and a flammable reducing agent such as LNG (liquefied natural gas), from a blast furnace tuyere.

BACKGROUND

In recent years, global warming due to an increase in the amount of emission of carbon dioxide is a problem. Even in the steel industry, reducing the amount of emitted $CO_2$ is an important issue. Therefore, in recent operations of blast furnaces, low reducing agent rate (low RAR) operations are greatly encouraged. (The reducing agent rate is the total amount of reducing agent blown in from a tuyere and coke fed from the top of a furnace, per 1 ton of pig iron manufactured). In a blast furnace, coke and pulverized coal injected from a tuyere are primarily used as reducing agents. To achieve a low reducing agent rate and, thus, suppress the amount of emission of carbon dioxide, it is effective to replace, for example, coke with a reducing agent having a high hydrogen content such as waste plastic, LNG, and heavy oil. Japanese Unexamined Patent Application Publication No. 2006-291251 below discusses that, when two or more lances that inject reducing agents from a tuyere are used and a flammable reducing agent such as LNG, and a solid reducing agent, such as pulverized coal, are injected from different lances, the lances are disposed so that an extension line of a lance that injects the flammable reducing agent and an extension line of a lance that injects the solid reducing agent do not cross each other.

Although, compared to a conventional method of injecting only pulverized coal from a tuyere, the method of operating a blast furnace in Japanese Unexamined Patent Application Publication No. 2006-291251 has the effect of increasing combustion temperature and reducing a unit consumption of reducing agent, it can be further improved.

It could therefore be helpful to provide a method of operating a blast furnace that makes it possible to further increase combustion temperature and reduce unit consumption of reducing agents.

SUMMARY

We thus provide a method of operating a blast furnace comprising:

providing two or more lances that inject reducing agents from a tuyere;

injecting a solid reducing agent and a flammable reducing agent from different lances;

disposing the lances so that an axial line that extends from an end of the lance that injects the solid reducing agent and is the axial line of the lance that injects the solid reducing agent and an axial line that extends from an end of the lance that injects the flammable reducing agent and is the axial line of the lance that injects the flammable reducing agent cross each other, and so that a main flow of the solid reducing agent injected and a main flow of the flammable reducing agent injected overlap.

It is desirable that the axial lines cross each other with a relative distance in a radial direction between the lance that injects the solid reducing agent and the lance that injects the flammable reducing agent being 20 mm or less.

It is desirable that the axial lines cross each other with a relative distance in a radial direction between the lance that injects the solid reducing agent and the lance that injects the flammable reducing agent being 13 mm or less.

It is desirable that the axial lines cross each other with a relative distance in a radial direction between the lance that injects the solid reducing agent and the lance that injects the flammable reducing agent being 10 mm or less.

It is desirable that the axial lines cross each other with a relative distance in a radial direction between the lance that injects the solid reducing agent and the lance that injects the flammable reducing agent being 0.

It is desirable that an outlet flow velocity at the lance that injects the solid reducing agent of the lances be 20 to 120 m/sec.

It is desirable that the lance that injects the solid reducing agent be a double wall lance, the solid reducing agent be injected from an inner tube of the double wall lance, a combustion-supporting gas be injected from an outer tube of the double wall lance, and the flammable reducing agent be injected from a single wall lance. It is desirable to use oxygen-enriched air having an oxygen concentration of 50% or higher as the combustion-supporting gas.

It is desirable that an outlet flow velocity at the outer tube of the double wall lance and an outlet flow velocity at the single wall lance be 20 to 120 m/sec.

It is desirable that the solid reducing agent be pulverized coal.

It is desirable that the pulverized coal, serving as the solid reducing agent, be mixed with waste plastic, refuse derived fuel, organic resource, or discarded material.

It is desirable that, with a proportion of the pulverized coal, serving as the solid reducing agent, being 80 mass % or higher, the waste plastic, the refuse derived fuel, the organic resource, or the discarded material be used to mix with the pulverized coal.

It is desirable that the flammable reducing agent be LNG, town gas, hydrogen, converter gas, blast-furnace gas, or coke-oven gas.

As a consequence, when the flows of the flammable reducing agent and the solid reducing agent injected from different lances overlap each other and the flammable reducing agent contacts $O_2$ and undergoes combustion earlier, explosive diffusion occurs and the temperature of the solid reducing agent is drastically increased. This makes it possible to drastically increase the combustion temperature and, thus, to reduce a unit consumption of reducing agent.

When the outlet flow velocity of gas injected from a lance is 20 to 120 m/sec, deformation of the lance caused by a rise in temperature can be prevented from occurring.

When, with the lance that injects the solid reducing agent being a double wall lance, a solid reducing agent is injected from the inner tube of the double wall lance and a combustion-supporting gas is injected from the outer tube, it is possible to provide oxygen necessary to the combustion of the solid reducing agent.

If the outlet flow velocity at the outer tube of the double wall lance and the outlet flow velocity at the single wall lance are 20 to 120 m/sec, deformation of the lance caused by an increase in temperature can be prevented from occurring.

BRIEF DESCRIPTION OF THE DRAWINGS

FIG. 6 shows combustion experiment results.

FIG. 7 shows the distance up to an ignition point when the relative distance between lances in a radial direction thereof is changed.

REFERENCE SIGNS LIST

Figure 1:
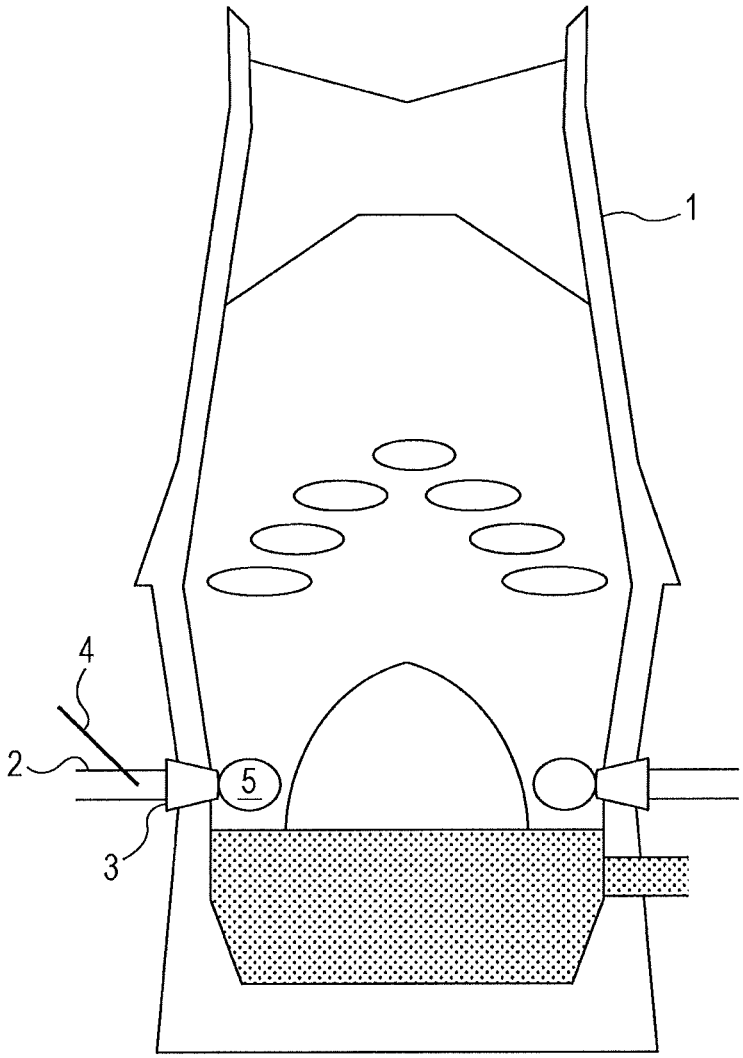
FIG. 1 is a vertical sectional view of an example of a blast furnace to which a method of operating a blast furnace is applied.

1 blast furnace
2 blow pipe
3 tuyere
4 lance
5 raceway
6 pulverized coal (solid reducing agent)
7 coke
8 char
9 LNG (flammable reducing agent)

DETAILED DESCRIPTION

Next, a method of operating a blast furnace is described with reference to the drawings.

FIG. 1 is an overall view of a blast furnace to which the method of operating a blast furnace is applied. As shown in FIG. 1, a blow pipe 2 that blows hot air connects to a tuyere 3 of a blast furnace 1. A lance 4 is set so as to extend through the blow pipe 2. A combustion space, which is called a "raceway" 5, exists at a coke deposit layer located in front of the tuyere 3 in a direction in which hot air is injected. In this combustion space, reduction of iron ore, that is, the production of pig iron is primarily performed.

Figure 2:
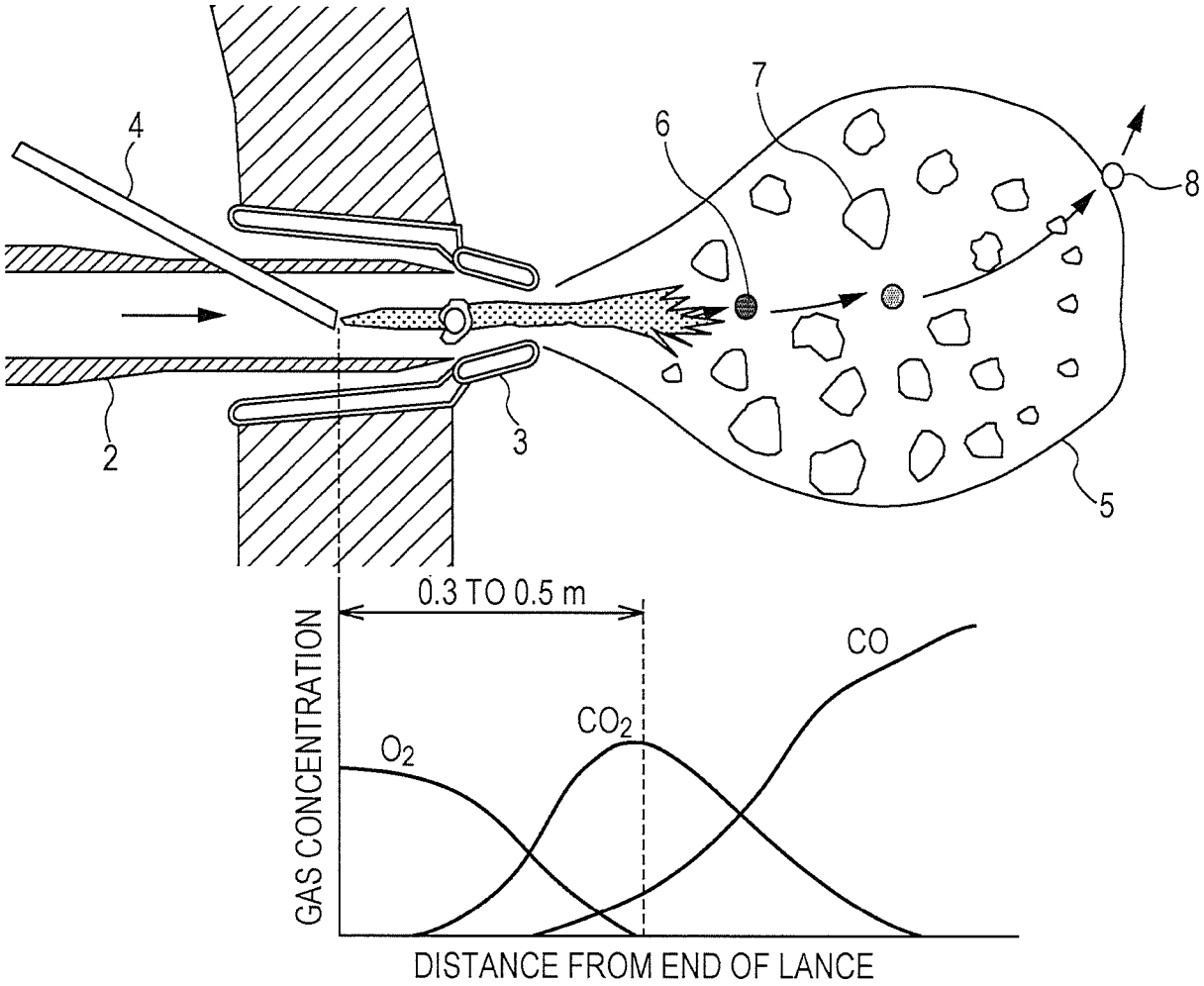
FIG. 2 illustrates a combustion state when only pulverized coal is injected from a lance in FIG. 1.

FIG. 2 illustrates a combustion state when only pulverized coal 6, serving as a solid reducing agent, is injected from the lance 4. The pulverized coal 6 passes through the tuyere 3 from the lance 4 and is injected into the raceway 5. Volatile matter and fixed carbon of the pulverized coal 6 undergo combustion along with coke 7, and the volatile matter is emitted to remain an aggregate of carbon and ash, which is generally called char. The char is discharged as unburned char 8 from the raceway. The hot blast velocity at a location situated in front of the tuyere 3 in the direction in which hot blast blows is approximately 200 m/sec, and the region of existence of $O_2$ in the raceway 5 from an end of the lance 4 is approximately 0.3 to 0.5 m. Therefore, it is necessary to virtually improve contact efficiency with $O_2$ (diffusibility) and raise the temperature of pulverized coal particles at a level of 1/1000 sec.

Figure 3:
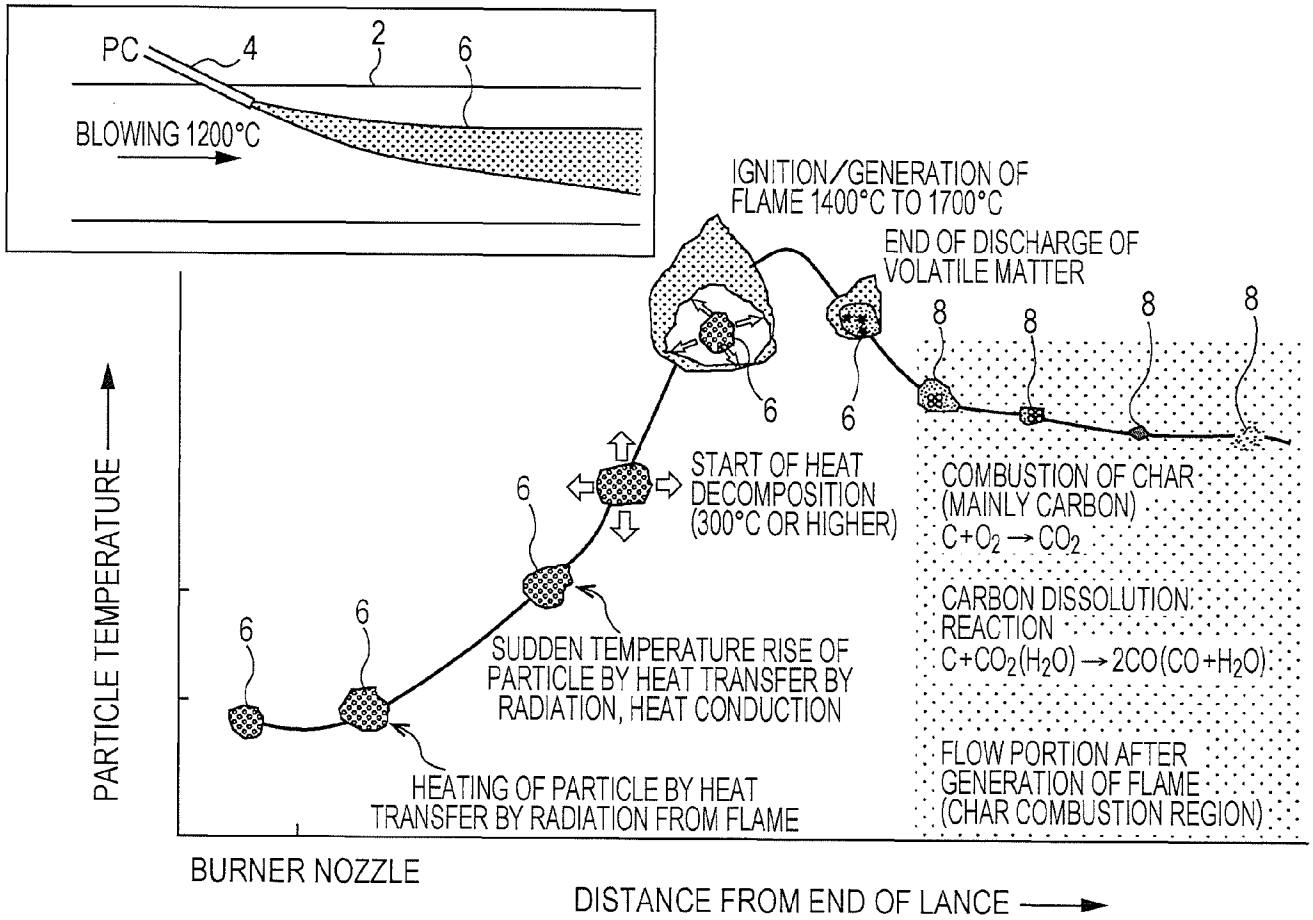
FIG. 3 illustrates a combustion mechanism of the pulverized coal in FIG. 2.

FIG. 3 illustrates a combustion mechanism when only the pulverized coal (in FIG. 3, PC) 6 is injected into the blow pipe 2 from the lance 4. Particles of the pulverized coal 6 injected into the raceway 5 from the tuyere 3 are heated by heat transfer by radiation from a flame in the raceway 5. Further, by heat transfer by radiation and heat conduction, the temperature of the particles is suddenly increased, and thermal decomposition is started from the time when the temperature has been raised to at least 300° C. so that the volatile matter is ignited. This causes a flame to be generated, and the combustion temperature reaches 1400 to 1700° C. If the volatile matter is discharged, the aforementioned char 8 is formed. The char 8 is primarily fixed carbon so that what is called a carbon dissolution reaction also occurs along with the combustion reaction.

Figure 4:
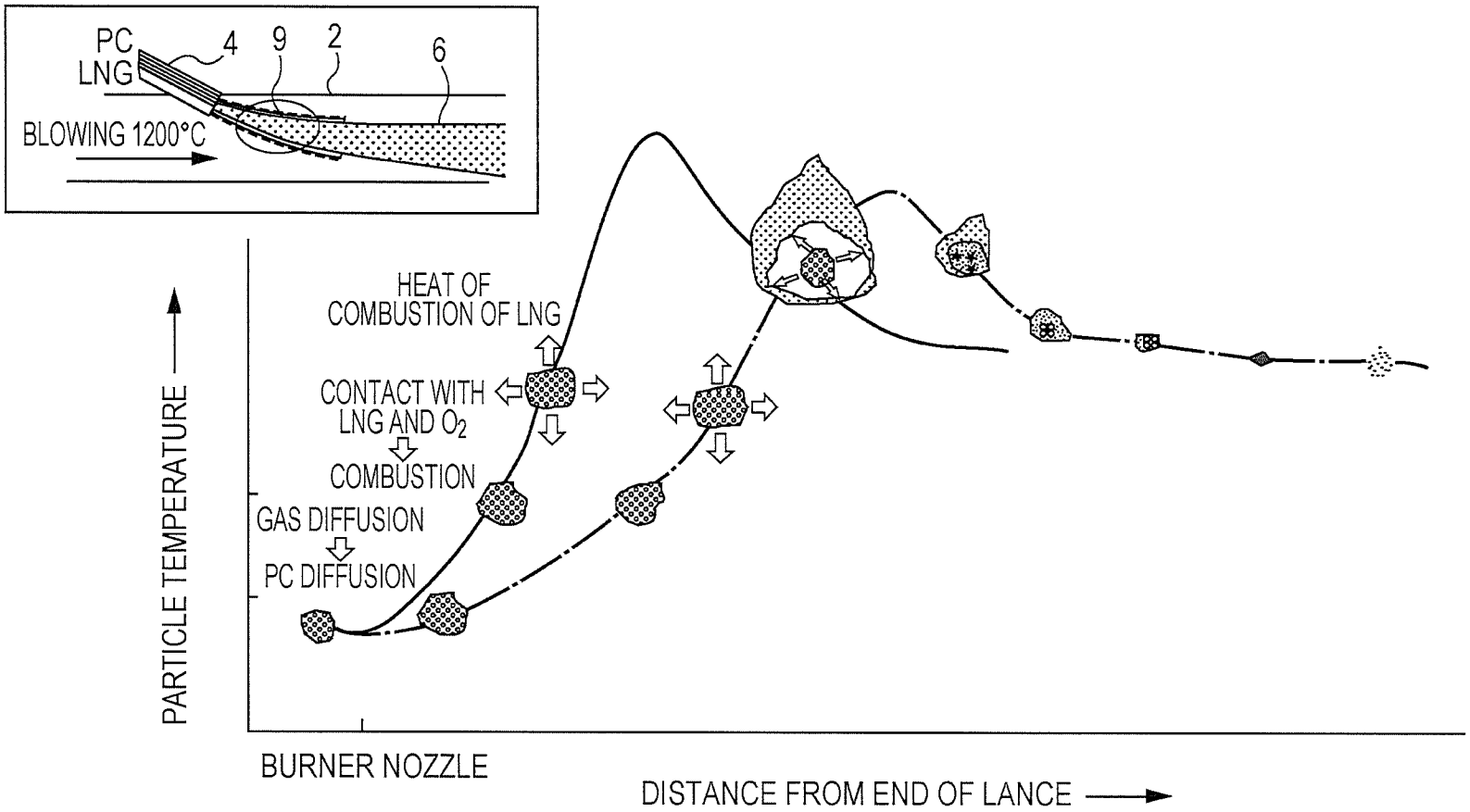
FIG. 4 illustrates a combustion mechanism when pulverized coal and LNG are injected.

FIG. 4 illustrates a combustion mechanism when the pulverized coal 6 and LNG 9, serving as a flammable reducing agent, are injected into the blow pipe 2 from the lance 4. The method of injecting the pulverized coal 6 and the LNG 9 is that when they are simply injected in parallel. The two-dot chain line in FIG. 4 is shown with the combustion temperature when only pulverized coal is injected as shown in FIG. 3 being used as a reference. We believe that, when the pulverized coal and the LNG are injected at the same time in this way, the LNG, which is a gas, precedingly undergoes combustion and combustion heat thereof suddenly heats the pulverized coal to raise its temperature. This causes the combustion temperature at a location close to the lance to further increase.

Figure 5:
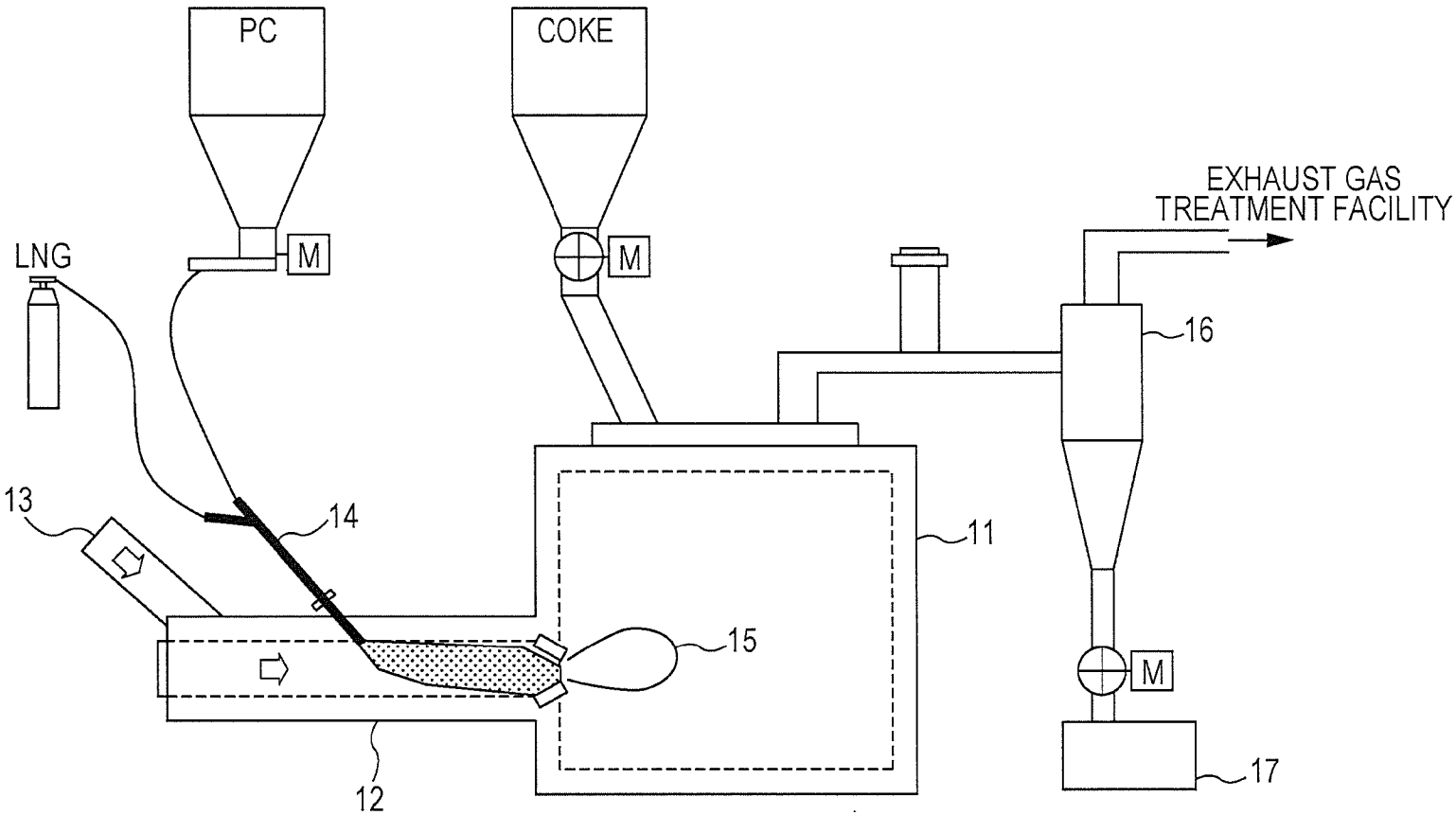
FIG. 5 illustrates a combustion experimental device.

On the basis of such knowledge, a combustion experiment was conducted using a combustion experimental device shown in FIG. 5. An experimental reactor 11 is filled with coke. The inside of a raceway 15 can be viewed from a viewing window. It is possible to blow a predetermined amount of hot air generated by a combustion burner 13 into the experimental reactor 11 when a lance 14 is inserted into a blow pipe 12. In this blow pipe 12, it is also possible to adjust the oxygen enrichment amount in the air blast. The lance 14 can be used to blow either one of the pulverized coal and the LNG into the blow pipe 12. Exhaust gas generated in the experimental reactor 11 is separated into exhaust gas and dust by a separator 16 that is called a cyclone. The exhaust gas is sent to an exhaust gas treatment facility such as an auxiliary furnace, and the dust is collected by a collecting box 17.

In the combustion experiment, two types of lances, a single wall lance and a double wall lance, were used for the lance 4. Diffusibility, combustion state of unburned char, combustion position, and combustion temperature were measured using a two-color thermometer from a viewing window for the following cases. In these cases in which only pulverized coal was injected using a single wall lance, the case in which a double wall lance was used to inject pulverized coal from an inner tube of the double wall lance and LNG was injected from an outer tube of the double wall lance, and the case in which LNG was injected from the inner tube of the double wall lance and pulverized coal was injected from the outer tube of the double wall lance.

As is well known, a two color thermometer is a radiation thermometer that measures temperature by making use of heat radiation (movement of electromagnetic waves from a high-temperature object to a low-temperature object). The two color thermometer is a wavelength distribution type in which temperature is determined by measuring a change in a wavelength distribution temperature while focusing on a shift of the wavelength distribution towards shorter wavelengths as the temperature increases. Since, in particular, the two color thermometer obtains a wavelength distribution, it measures radiant energy in two wavelengths and measures the temperature from the ratio. The combustion state of unburned char was determined by collecting the unburned char with a probe at a position of 150 mm and 300 mm from an end of the lance 14 at the blow pipe 12 of the experimental furnace 11, performing resin embedding, polishing, and then measuring the void ratio in the char by image analysis.

The pulverized coal contained 77.8% of fixed carbon (FC), 13.6% of volatile matter (VM), and 8.6% of ash. The injecting condition was 29.8 kg/h (equivalent to 100 kg per 1 t of molten iron). The condition for injecting LNG was 3.6 kg/h (equivalent to 5 $Nm^3/h$, 100 kg per 1 t of molten iron). The blowing conditions were: blowing temperature=1200° C., flow rate=300 $Nm^3/h$, flow velocity=70 m/s, and $O_2$ enrichment+5.5 (oxygen concentration of 26.5%, enrichment of 5.5% with respect to oxygen concentration of 21% in air). In a system of transporting powder, that is, pulverized coal with a small amount of gas (high-concentration transport), the solid-gas ratio is 10 to 25 $kg/Nm^3$, whereas, in a system of transporting it with a large amount of gas (low-concentration transport), the solid-gas ratio is 5 to 10 $kg/Nm^3$. Air may be used for the transport gas. In evaluating the experimental results, evaluations were made for the case in which pulverized coal was injected from an inner tube of a double wall lance and LNG was injected from an outer tube and the case in which LNG was injected from the inner tube of the double wall lance and pulverized coal was injected from the outer tube. The evaluations were performed with reference to the combustion temperature, the combustion position, the combustion state of unburned char, and diffusibility (primarily pulverized coal) in the case in which only pulverized coal was injected from a single tube. In the evaluations, results that were about the same as those of the case in which only pulverized coal was injected are indicated by a triangle. Results showing slight improvements compared to the results of the case in which only pulverized coal was injected are indicated by a circle. Results showing considerable improvements compared to the results of the case in which only pulverized coal was injected are indicated by a double circle.

FIG. 6 shows the results of the above-described combustion experiment. As is clear from FIG. 6, when pulverized coal is injected from the inner tube of the double wall lance and LNG is injected from the outer tube, improvements are made regarding the combustion position, whereas no changes are seen regarding the other items. We believe this is because, although LNG at the outer side of the pulverized coal contacts $O_2$ earlier and undergoes combustion quickly and the combustion heat thereof increases the heating speed of the pulverized coal, $O_2$ is consumed in the combustion of LNG and, therefore, $O_2$ required for the combustion of the pulverized coal is reduced, as a result of which the combustion temperature is not sufficiently raised and the combustion state of the unburned char is also not improved.

In contrast, when LNG is injected from the inner tube of the double wall lance and pulverized coal is injected from the outer tube, improvements are made regarding the combustion temperature and the combustion state of the unburned char and considerable improvements are made regarding diffusibility, whereas there are no changes seen regarding the combustion position. We believe this because, although it takes time to diffuse $O_2$ up to the inner-side LNG via an outer-side pulverized coal region, if the inner-side flammable LNG undergoes combustion, explosive diffusion occurs so that the pulverized coal is heated by the combustion heat of LNG and the combustion temperature is also increased, as a result of which the combustion state of the unburned char is also improved.

On the basis of the experimental results, using the aforementioned combustion experimental device, we inserted, from above and below the blow pipe, two single wall lances into the blow pipe at the tuyere to oppose each other, for example, towards the inner side of the furnace; injected pulverized coal from one of the lances; injected LNG from the other lance; and variously changed the relative distance between the two lances in a radial direction to measure the distance to an ignition point from the lance that injects the pulverized coal. In the air blast, oxygen enrichment was performed. The measurement results are shown in FIG. 7. The circles at the lower portion of FIG. 7 indicate the states of the lances with the inside of the blow pipe being seen from a near side in the injecting direction. The relative distance between the two lances in the radial direction corresponds to D in FIG. 7.

Figure 8:
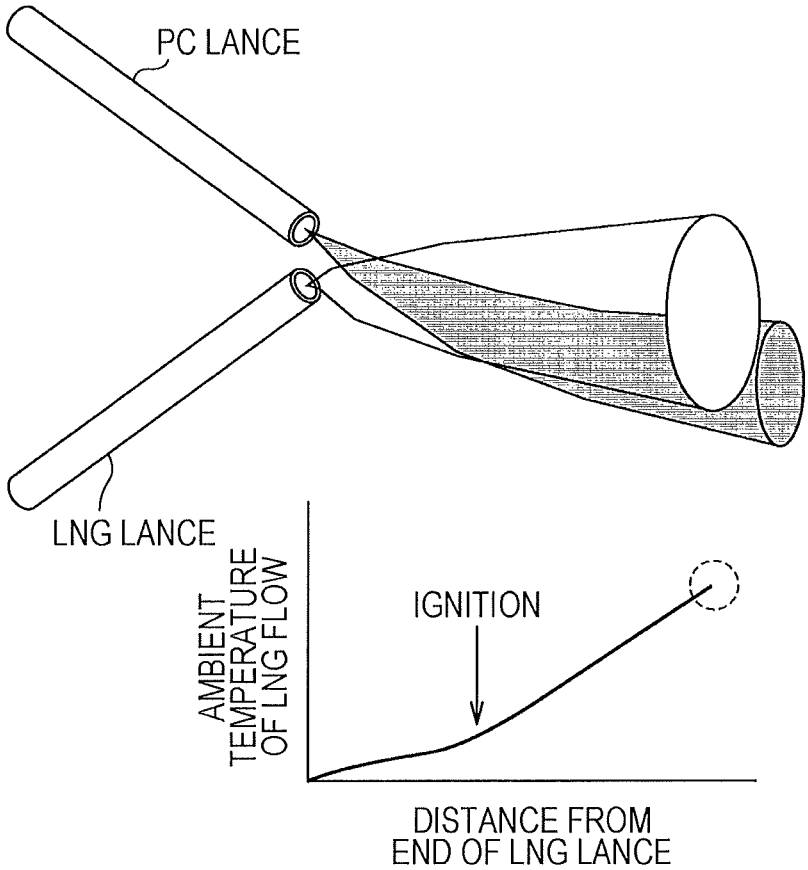
FIG. 8 is a conceptual view of the flow of pulverized coal and the flow of LNG when the relative distance between two lances in a radial direction is large.
Figure 9:
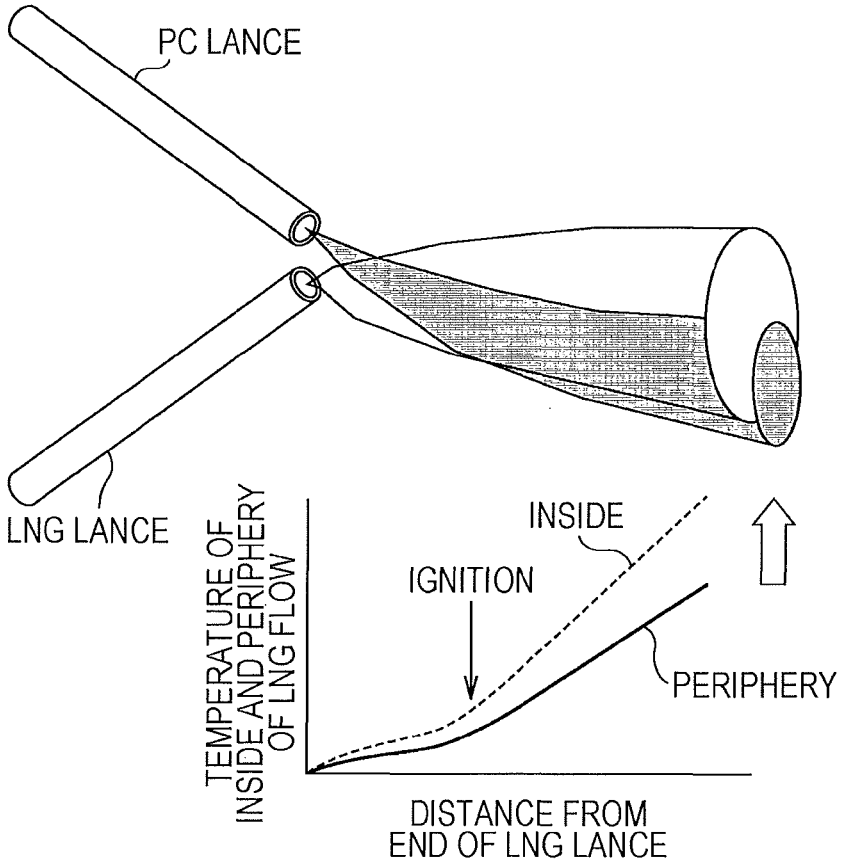
FIG. 9 is a conceptual view of the flow of pulverized coal and the flow of LNG when the relative distance between the two lances in the radial direction is small.

FIG. 8 is a conceptual view of the flow of pulverized coal and the flow of LNG when the relative distance D between two lances in a radial direction is large. FIG. 9 is a conceptual view of the flow of pulverized coal and the flow of LNG when the relative distance D between the two lances in the radial direction is small. When the relative distance D between the two lances in the radial direction is small and the lances are close to each other, main flows of pulverized coal and LNG injected from the two lances start to overlap, as a result of which the pulverized coal flow is directly enveloped by a combustion field of LNG. As a result, in an LNG combustion high-temperature region, the temperature of the pulverized coal is rapidly increased and ignition combustion occurs. Therefore, the ignition time is reduced.

As is clear from FIG. 7, the smaller the relative distance D between the two lances in the radial direction, the smaller the distance to the ignition point from an end of the lance that injects the pulverized coal (PC lance in FIG. 7), that is, the smaller the combustion start time. We believe this is because, the smaller the relative distance between the two lances in the radial direction, the more easily the main flows of the pulverized coal and LNG that are injected overlap each other so that, at the overlapped portion, an increase in temperature and diffusion caused by the combustion of LNG as mentioned above occur, as a result of which the combustion of the pulverized coal occurs easily. Further, we believe that, if the combustion start time is reduced, the combustion temperature is also increased.

Although, to reduce the ignition time as the relative distance between the two lances in the radial direction is reduced, an axial line that extends from an end of the lance that injects pulverized coal and is that of this lance and an axial line that extends from an end of the lance that injects LNG and is that of this lance need to cross each other, they do not need to completely cross each other. It is possible to reduce the ignition time as long as the relative distance D between the axial line of the lance that injects pulverized coal and the axial line of the lance that injects LNG is within 20 mm when viewed at the relative distance D between the two lances in the radial direction. When the relative distance D is desirably within 13 mm and is more desirably within 10 mm, variations can be reduced in addition to reducing the ignition time. In addition, if the relative distance between the two lances in the radial direction is 0, the extension lines of the lances, that is, the axial lines of the lances extending from the corresponding ends of the lances completely cross each other, at which time, the ignition time is shortest.

Even if the lance that injects LNG is disposed closer to a furnace side (LNG furnace side in the figure) than the lance that injects pulverized coal is, that is, disposed in front of the lance that injects pulverized coal, the ignition time is reduced. However, if the position of the end of the lance that injects LNG and the position of the end of the lance that injects pulverized coal are made to correspond with each other (the ends are aligned in the figure), or if the end of the lance that injects LNG is disposed closer to the blowing side (LNG injecting side in the figure), that is, the near side than the end of the lance that injects pulverized coal is, in other words, when the lance that injects pulverized coal is situated in front of the lance that injects LNG in the injecting direction, the ignition time is further reduced.

That is, if the position of a blow-in end of the lance that injects LNG and the position of a blow-in end of the lance that injects pulverized coal are made to correspond to each other in the injecting direction, or if the end of the lance that injects LNG is situated closer to the near side than the end of the lance that injects pulverized coal in the injecting direction, pulverized coal is injected into the combustion main flow of LNG that is injected first. The temperature of pulverized coal that has been injected by a high temperature field in the combustion main flow of LNG is rapidly increased so that the ignition time is reduced.

Next, single wall lances were used as lances and the combustion temperature and distance from an end of each lance were measured for the following cases. The cases are those in which only pulverized coal was injected from the two lances whose extension lines did not cross each other; the case in which, while similarly extension lines of two lances did not cross each other, pulverized coal was injected from one of the lances and LNG was injected from the other lance; and the case in which, while extension lines of two lances crossed each other at 20 mm or less, pulverized coal was injected from one of the lances and LNG was injected from the other lance.

Figure 10:
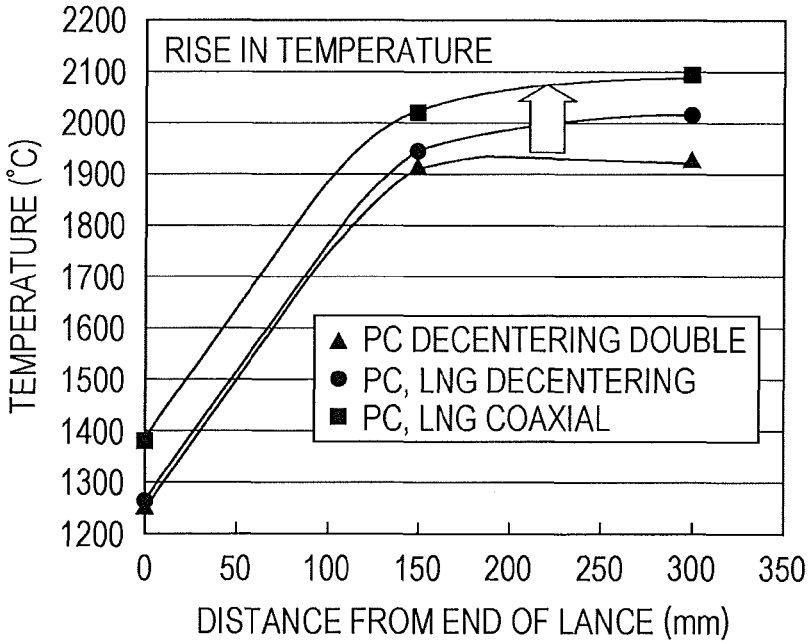
FIG. 10 shows the combustion temperature when extension lines of lances do not cross each other.

The measurement results are shown in FIG. 10. "PC decentering double" in FIG. 10 indicates a case in which, while the extension lines of the two lances did not cross each other, only pulverized coal was injected from the two lances; "PC, LNG decentering" in FIG. 10 indicates a case in which, while the extension lines of the two lances did not cross each other, pulverized coal was injected from one of the lances and LNG was injected from the other lance; and "PC, LNG coaxial" indicates a case in which, while the extension lines of the two lances crossed each other, pulverized coal was injected from one of the lances and LNG was injected from the other lance. As is clear from FIG. 10, the combustion temperature is highest for the case in which, while the extension lines of the two lances crossed each other, pulverized coal was injected from one of the lances and LNG was injected from the other lance.

Figure 11:
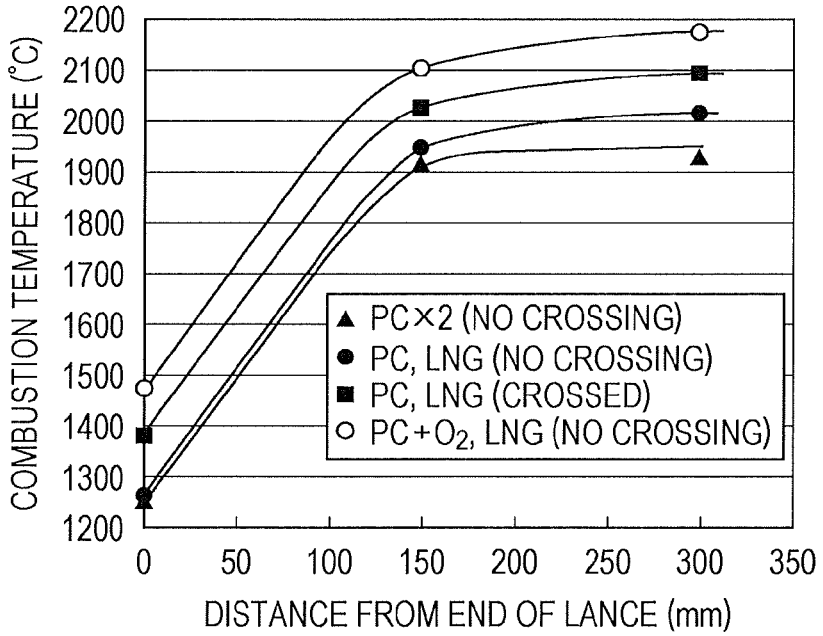
FIG. 11 shows the combustion temperature when extension lines of a double wall lance do not cross each other.

Further, to increase combustion efficiency of pulverized coal, a double wall lance that injects pulverized coal is also used. When a double wall lance was used, pulverized coal was injected from an inner tube of the double wall lance and $O_2$, serving as combustion supporting gas, was injected from an outer tube, to measure the combustion temperature and the distance from an end of the double wall lance that injects pulverized coal. LNG was injected from a single wall lance. Even when only pulverized coal was injected, a single wall lance was used. The measurement results are shown in FIG. 11. "PC×2 (does not cross)" in FIG. 11 indicates a case in which, while extension lines of two single wall lances did not cross each other, only pulverized coal was injected from the two lances. "PC, LNG (does not cross)" in FIG. 11 indicates a case in which, while extension lines of two single wall lances did not cross each other, pulverized coal was injected from one of the lances and LNG was injected from the other lance. "PC, LNG (crossed)" in FIG. 11 indicates a case in which, while extension lines of two single wall lances crossed each other, pulverized coal was injected from one of the lances and LNG was injected from the other lance. "PC+$O_2$, LNG (cross)" in FIG. 11 indicates a case in which, while an extension line of a double wall lance and an extension line of a single wall lance crossed each other, pulverized coal was injected from an inner tube of the double wall lance, $O_2$ was injected from an outer tube thereof, and LNG was injected from the single wall lance.

As is clear from FIG. 11, the combustion temperature is high for the case in which, while the extension lines of the two lances crossed each other, pulverized coal was injected from one of the lances and LNG was injected from the other lance; and is highest for the case in which, while the extension lines of the two lances crossed each other, pulverized coal was injected from the inner tube of the double wall lance, $O_2$ was injected from the outer tube thereof, and LNG was injected from the single wall lance. We believe this to be because $O_2$ required for the combustion of pulverized coal is provided by compensating for the consumption of $O_2$ in the air blast by the combustion of LNG that occurs earlier.

As the combustion temperature increases as described above, a lance tends to be exposed to high temperatures. The lance is, for example, a stainless steel tube. Obviously, although the lance is subjected to water cooling that uses what is called a water jacket, it cannot cover locations up to ends of the lance. In particular, we found that end portions of the lance that cannot be reached by water cooling tend to be deformed by heat. If the end of the lance that injects LNG is disposed closer to the near side (blowing side) in the injecting direction than the end of the lance that injects pulverized coal is, the end of the lance that injects pulverized coal enters an LNG combustion high-temperature region. Therefore, the lance is deformed more easily.

When the lance is deformed, that is, is bent, pulverized coal and LNG cannot be injected to a desired portion, and replacement of the lance, which is a consumable, is hindered. In addition, the flow of pulverized coal may change and strike the tuyere, in which case the tuyere may become damaged. When the lance is bent and clogged and, as a result, gas no longer flows through the lance, the lance is eroded, in which case the blow pipe may become damaged. If the lance is deformed or worn, it is no longer possible to ensure a combustion temperature such as that mentioned above and, therefore, a unit consumption of reducing agent also cannot be reduced.

To cool a lance that cannot be water-cooled, the lance can only be cooled by heat dissipation using gas that is supplied to its interior. We believe that, if the lance itself is cooled by heat-dissipation to the gas flowing in the interior thereof, the flow velocity of the gas influences the temperature of the lance. Therefore, we measured the temperature of the surface of a lance by variously changing the flow velocity of the gas injected from the lance. In an experiment using a double wall lance, $O_2$ was injected from an outer tube of the double wall lance and pulverized coal was injected from an inner tube, and the gas flow velocity was adjusted by changing the supply amount of $O_2$ injected from the outer tube. The $O_2$ may be oxygen-enriched air. Oxygen-enriched air of 2% or more, or, desirably, of 10% or more is used. By using oxygen-enriched air, combustibility of pulverized coal, in addition to cooling, is enhanced. The measurement results are shown in FIG. 12.

As the outer tube of the double wall lance, a steel tube, called a 20A schedule 5S tube, was used. As the inner tube of the double wall lance, a steel tube, called a 15A schedule 90 tube, was used, and the temperature of the surface of the lance was measured by variously changing the total flow velocity of $N_2$ and $O_2$ injected from the outer tube. "15A" and "20A" refer to the outside diameters of steel tubes that are specified in JIS G 3459. 15A corresponds to an outside diameter of 21.7 mm, and 20A corresponds to an outside diameter of 27.2 mm. "Schedule" refers to wall thickness of steel tubes specified in JIS G 3459. 20A schedule 5S corresponds to a wall thickness of 1.65 mm, and 15A schedule 90 corresponds to a wall thickness of 3.70 mm. In addition to stainless steel, ordinary steel may be used. The outside diameter of a steel tube in this case is specified in JIS G 3452, and the wall thickness thereof is specified in JIS G 3454.

Figure 12:
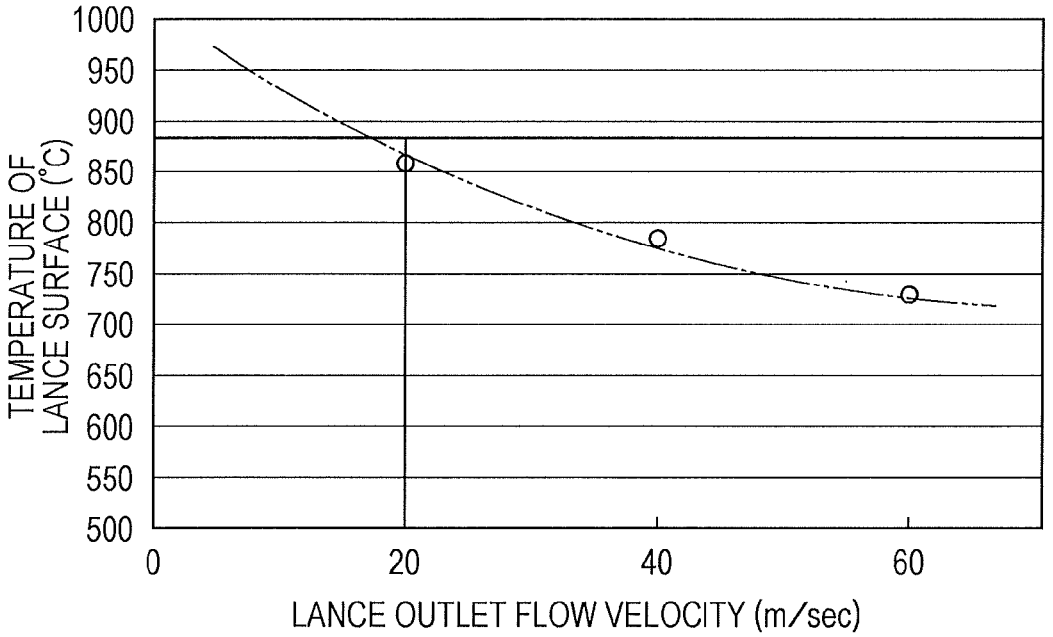
FIG. 12 illustrates the relationship between the outlet flow velocity at a lance and the surface temperature of the lance.

As shown by the alternate long and two short dashes line in FIG. 12, as the flow velocity of gas injected from the outer tube of the double wall lance is increased, the temperature of the surface of the lance is inversely proportionally reduced. When steel tubes are used in the double wall lance, if the surface temperature of the double wall lance exceeds 880° C., creep deformation occurs, thereby causing the double wall lance to bend. Therefore, an outlet flow velocity at the outer tube of the double wall lance, in which a 20A schedule 5S steel tube is used for the outer tube of the double wall lance and whose surface temperature is 880° C. or lower, is 20 m/sec or higher. If the outlet flow velocity at the outer tube of the double wall lance is 20 m/sec or higher, the double wall lance is not deformed or bent. In contrast, if the outlet flow velocity at the outer tube of the double wall lance exceeds 120 m/sec, this is not practical from the viewpoint of operation costs of a facility. Therefore, the upper limit of the outlet flow velocity at the outer tube of the double wall lance is 120 m/sec. As a result, since the same actions occur at end portions of single wall lances that cannot be similarly reached by water cooling, the outlet flow velocity at the single wall lance is also 20 to 120 m/sec. Since heat load on a single wall lance is less than that on a double wall lance, the outlet flow velocity is set at 20 m/sec or higher as necessary.

Although, in the example, the average particle diameter of pulverized coal is 10 to 100 μm, when combustibility is to be ensured and supply from a lance and suppliability to a lance are considered, it is desirably 20 to 50 μm. When the average particle diameter of pulverized coal is less than 20 μm, combustibility is excellent. However, the lance tends to be clogged when the pulverized coal is transported (gas is transported). When it exceeds 50 μm, the combustibility of pulverized coal may be reduced.

The solid reducing agent to be injected may primarily contain pulverized coal with waste plastic, refuse derived fuel (RDF), organic resource (biomass), or discarded material mixed therewith. When a mixture is used, it is desirable that the ratio of pulverized coal with respect to the whole solid reducing agent be 80 mass % or higher. That is, the heat quantities resulting from reactions of pulverized coal differ from those resulting from reactions of, for example, waste plastic, refuse derived fuel (RDF), organic resource (biomass), and discarded material.

Therefore, if the ratios with which they are used approach each other, combustion tends to be uneven, as a result of which operation tends to become unstable. In addition, compared to pulverized coal, the heat quantities resulting from combustion reactions of, for example, waste plastic, refuse derived fuel (RDF), organic resource (biomass), and discarded material are low. Therefore, when they are injected in large amounts, the substitution efficiency with respect to the solid reducing agent that is charged from the top of the furnace is reduced. Consequently, it is desirable that the proportion of pulverized coal be 80 mass % or higher.

Waste plastic, refuse derived fuel (RDF), organic resource (biomass), and discarded material may be mixed with pulverized coal as granules that are not more than 6 mm, desirably, not more than 3 mm. The proportion with respect to pulverized coal is such that they are mixable with the pulverized coal by causing them to merge with the pulverized coal that is pneumatically transported by transport gas. They may be used by being previously mixed with pulverized coal.

Further, although, in the example, a description is given using LNG as a flammable reducing agent, it is also possible to use town gas. As flammable reducing agents other than town gas and LNG, in addition to propane gas and hydrogen, converter gas, blast-furnace gas, and coke-oven gas, generated at steel mills, may be used. Shale gas may be used as an equivalent to LNG. Shale gas is a natural gas extracted from shale layers. Since shale gas is produced at places that are not existing gas fields, shale gas is called unconventional natural gas.

Accordingly, in the method of operating a blast furnace, two or more lances that inject reducing agents from a tuyere are used, and the lances are disposed so that an axial line that extends from an end of the lance that injects LNG (flammable reducing agent) and is that of this lance and an axial line that extends from an end of the lance that injects pulverized coal (solid reducing agent) and is that of this lance cross each other. Therefore, main flows of pulverized coal (solid reducing agent) and LNG (flammable reducing agent) injected from different lances overlap. LNG (flammable reducing agent) contacts $O_2$ and undergoes combustion earlier so that explosive diffusion occurs and the temperature of the pulverized coal (solid reducing agent) is drastically increased. This makes it possible to drastically increase the combustion temperature and, thus, to reduce the unit consumption of reducing agent.

When the outlet flow velocity of gas that is injected from the lance that injects pulverized coal (solid reducing agent) of the lances is 20 to 120 m/sec, deformation of the lance caused by a rise in temperature can be prevented from occurring.

When, with the lance that injects pulverized coal (solid reducing agent) being a double wall lance, pulverized coal (solid reducing agent) is injected from an inner tube of the double wall lance and oxygen (combustion-supporting gas) is injected from an outer tube, it is possible to provide oxygen necessary to the combustion of the solid reducing agent.

If the outlet flow velocity at the outer tube of the double wall lance and the outlet flow velocity at the single wall lance are 20 to 120 m/sec, deformation of the lances caused by a rise in temperature can be prevented from occurring.

Although, in the example, two lances that inject reducing agents are used, any number of lances may be used as long as the number of lances is two or more. In addition, double wall lances may be used for the lances. If double wall lances are used, a combustion-supporting gas such as oxygen, and a flammable reducing agent may be injected. What is required is that the lances be disposed so that an axial line that extends from an end of the lance that injects a flammable reducing agent and is that of this lance and an axial line that extends from an end of the lance that injects a solid reducing agent and is that of this lance cross each other, and so that main flows of the flammable reducing agent and the solid reducing agent that are injected overlap each other.

The invention claimed is:

1. A method of operating a blast furnace comprising:

providing two or more lances that inject reducing agents from a tuyere;

injecting a solid reducing agent and a flammable reducing agent from different lances; and disposing the lances so that an axial line that extends in an injecting direction from an end of the lance that injects the solid reducing agent and is the axial line of the lance that injects the solid reducing agent and an axial line that extends in an injecting direction from an end of the lance that injects the flammable reducing agent and is the axial line of the lance that injects the flammable reducing agent cross each other, and so that a main flow of the solid reducing agent injected and a main flow of the flammable reducing agent injected overlap, wherein the lances are aligned in an injecting direction, or the end of the lance that injects the flammable reducing agent is disposed closer to a near side than the end of the lance that injects the solid reducing agent in the injecting direction.

2. The method according to claim 1, wherein the axial lines cross each other with a relative distance in a radial direction between an injection end of the lance that injects the solid reducing agent and an injection end of the lance that injects the flammable reducing agent being 20 mm or less.

3. The method according to claim 1, wherein the axial lines cross each other with a relative distance in a radial direction between an injection end of the lance that injects the solid reducing agent and an injection end of the lance that injects the flammable reducing agent being 13 mm or less.

4. The method according claim 1, wherein the axial lines cross each other with a relative distance in a radial direction between an injection end of the lance that injects the solid reducing agent and an injection end of the lance that injects the flammable reducing agent being 10 mm or less.

5. The method according to claim 1, wherein the axial lines cross each other with a relative distance in a radial direction between an injection end of the lance that injects the solid reducing agent and an injection end of the lance that injects the flammable reducing agent being 0.

6. The method according to claim 1, wherein an outlet flow velocity at the lance that injects the solid reducing agent of the lances is 20 to 120 m/sec.

7. The method according to claim 1, wherein the lance that injects the solid reducing agent is a double wall lance, the solid reducing agent is injected from an inner tube of the double wall lance, a combustion-supporting gas is injected from an outer tube of the double wall lance; and the flammable reducing agent is injected from a single wall lance.

8. The method according to claim 7, wherein an outlet flow velocity at the outer tube of the double wall lance and an outlet flow velocity at the single wall lance are 20 to 120 m/sec.

9. The method according to claim 1, wherein the solid reducing agent is pulverized coal.

10. The method according to claim 9, wherein the pulverized coal, serving as the solid reducing agent, is mixed with waste plastic, refuse derived fuel, organic resource, or discarded material.

11. The method according to claim 10, wherein a proportion of the pulverized coal to the solid reducing agent is 80 mass % or higher; and the waste plastic, the refuse derived fuel, the organic resource, or the discarded material is used to mix with the pulverized coal.

12. The method according to claim 1, wherein the flammable reducing agent is LNG, shale gas, town gas, hydrogen, converter gas, blast-furnace gas, or coke-oven gas.

13. The method according to claim 2, wherein the axial lines cross each other with a relative distance in a radial direction between an injection end of the lance that injects the solid reducing agent and an injection end of the lance that injects the flammable reducing agent being 13 mm or less.

14. The method according to claim 2, wherein the axial lines cross each other with a relative distance in a radial direction between an injection end of the lance that injects the solid reducing agent and an injection end of the lance that injects the flammable reducing agent being 10 mm or less.

15. The method according to claim 3, wherein the axial lines cross each other with a relative distance in a radial direction between an injection end of the lance that injects the solid reducing agent and an injection end of the lance that injects the flammable reducing agent being 10 mm or less.

16. The method according to claim 2, wherein the axial lines cross each other with a relative distance in a radial direction between an injection end of the lance that injects the solid reducing agent and an injection end of the lance that injects the flammable reducing agent being 0.

17. The method according to claim 3, wherein the axial lines cross each other with a relative distance in a radial direction between an injection end of the lance that injects the solid reducing agent and an injection end of the lance that injects the flammable reducing agent being 0.

18. The method according to claim 4, wherein the axial lines cross each other with a relative distance in a radial direction between an injection end of the lance that injects the solid reducing agent and an injection end of the lance that injects the flammable reducing agent being 0.

* * * * *